US009004429B2

(12) United States Patent
Dennison

(10) Patent No.: US 9,004,429 B2
(45) Date of Patent: Apr. 14, 2015

(54) CURTAIN TRACK ASSEMBLY AND MOUNTING DEVICE

(75) Inventor: Roger F. Dennison, Christchurch (NZ)

(73) Assignee: MCP New Zealand Limited, Christchurch (NZ)

( * ) Notice: Subject to any disclaimer, the term of this patent is extended or adjusted under 35 U.S.C. 154(b) by 261 days.

(21) Appl. No.: 13/635,534

(22) PCT Filed: Mar. 18, 2011

(86) PCT No.: PCT/NZ2011/000035

§ 371 (c)(1), (2), (4) Date: Sep. 17, 2012

(87) PCT Pub. No.: WO2011/119050

PCT Pub. Date: Sep. 29, 2011

(65) Prior Publication Data

US 2013/0007988 A1 Jan. 10, 2013

(30) Foreign Application Priority Data

Mar. 22, 2010 (NZ) ..... 584134

(51) Int. Cl.

| | |
|---|---|
| ***A47H 1/14*** | (2006.01) |
| ***E06B 9/00*** | (2006.01) |
| ***A47H 1/144*** | (2006.01) |
| ***A47H 1/04*** | (2006.01) |
| ***A47H 1/104*** | (2006.01) |

(52) U.S. Cl.

CPC ..... *A47H 1/144* (2013.01); *Y10T 16/375* (2015.01); *A47H 1/04* (2013.01); *A47H 1/104* (2013.01); *Y10S 160/902* (2013.01)

(58) Field of Classification Search

CPC ..... A47H 1/04; A47H 1/10; A47H 1/06; A47H 1/08; A47H 1/104; A47H 2001/042; A47H 2001/045; A47H 2001/047; A47H 1/144

USPC ..... 248/251–252, 254, 261–262, 266–268, 248/273, 208; 160/178.1 R, 178.1 V, 118, 160/194, 368.1, 369, 405, 902, 19, 38; 16/94 D, 96 R, 96 D

See application file for complete search history.

(56) References Cited

U.S. PATENT DOCUMENTS 2,148,848 A * 2/1939 Wiley ..... 24/104
4,411,401 A * 10/1983 Anderson ..... 248/262

(Continued)

FOREIGN PATENT DOCUMENTS

AU 200036475 A1 11/2000
GB 2235866 A 3/1991

(Continued)

OTHER PUBLICATIONS

Examination Report for United Kingdom Application No. GB1217208.6, dated Jan. 27, 2014, (2 pages).
International Search Report and Written Opinion for International Application No. PCT/NZ2011/000035 mailed May 23, 2011 (8 pages).
International Preliminary Report on Patentability for International Application No. PCT/NZ2011/000035, issued Sep. 25, 2012 (5 pages).

*Primary Examiner* — Christopher Garft
(74) *Attorney, Agent, or Firm* — Clark & Elbing LLP

(57) ABSTRACT

A mounting device for installing a track for a curtain or blind has an engagement portion for cooperation with the track by a snap-type engagement. A resiliently deformable release means has a tongue portion (29) that has a free end that is positioned in a cavity of the track when the engagement portions are fully mutually engaged and a connected end that is connected to the mounting portion and spaced from the free end and that is positioned externally of the cavity of the track when the engagement portions are fully mutually engaged. The tongue portion (29) has an abutment face (33) disposed for assisting with prising apart the mounting device and the track by turning a tool, simultaneous with the operation of the tool against the tongue portion. The abutment face is opposed to and spaced from the track in use.

26 Claims, 5 Drawing Sheets

(56) References Cited

U.S. PATENT DOCUMENTS

| | | | | | |
|---|---|---|---|---|---|
| 5,074,350 | A | * | 12/1991 | Carter | 160/178.1 R |
| 5,353,857 | A | * | 10/1994 | Anderson | 160/178.1 R |
| 2005/0252614 | A1 | | 11/2005 | Drew et al. | |

FOREIGN PATENT DOCUMENTS

| | | | |
|---|---|---|---|
| GB | 2337920 | A | 12/1999 |
| NZ | 314988 | A | 11/1999 |
| NZ | 528581 | A | 9/2005 |

* cited by examiner

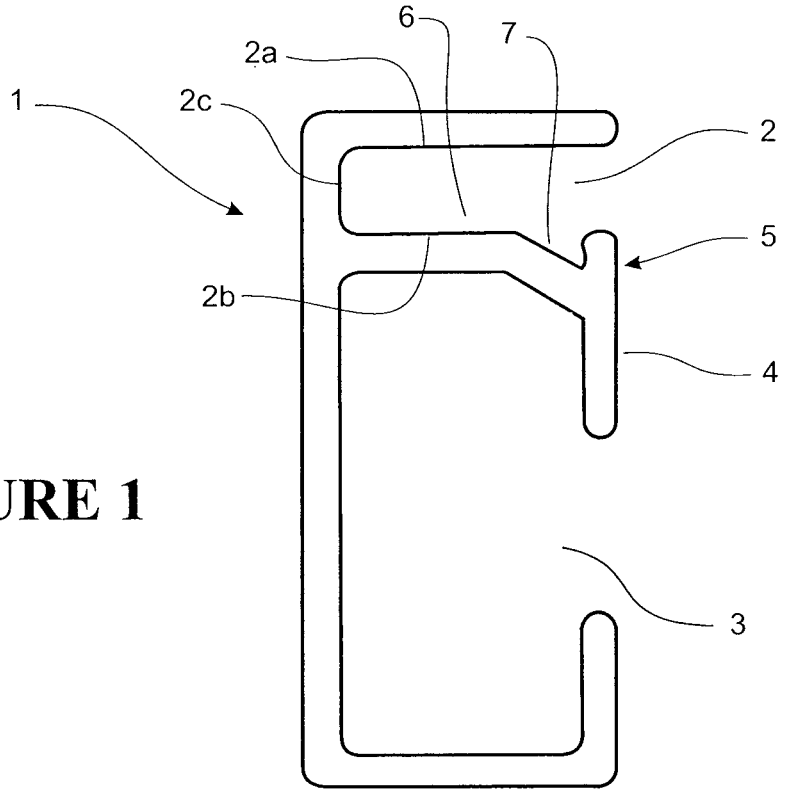
FIGURE 1
FIGURE 2
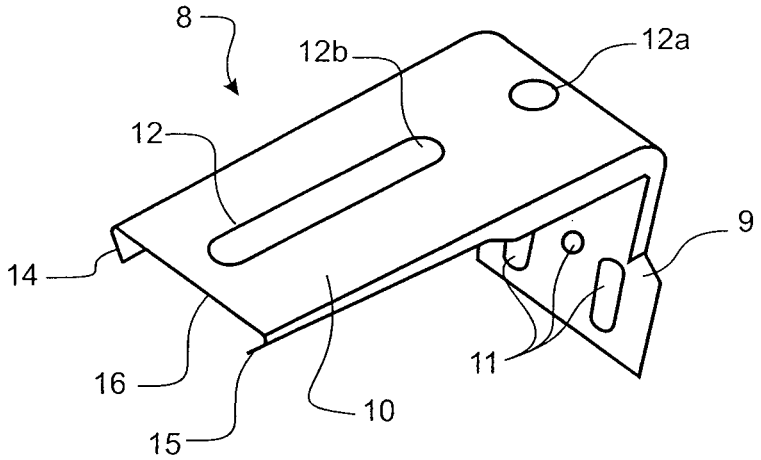

CURTAIN TRACK ASSEMBLY AND MOUNTING DEVICE

CROSS-REFERENCE TO RELATED APPLICATIONS

This application is the U.S. National Stage filing under 35 U.S.C. §371 of International Application No. PCT/NZ2011/000035, filed Mar. 18, 2011, which claims the benefit of New Zealand Patent Application No. 584134, filed Mar. 22, 2010.

FIELD OF THE INVENTION

The present invention relates to a track arrangement for curtains or blinds. In particular, the invention relates to a track assembly which is simple to install and yet enables the track to be separated from its mounting brackets for adjustment, maintenance or cleaning. The invention also relates to a mounting device for installing a track. Whilst the present invention has been described in connection with tracks for curtains and blinds, the invention may have application beyond window furnishings. The invention may be utilised for any sliding panels or leaves, for example room dividers, for any commercial or domestic application.

BACKGROUND TO THE INVENTION

Modern curtain fittings generally comprise an extruded metal track which defines a channel. Gliders are slidably received in the channel and include an eyelet through which a curtain hook may be inserted to thereby support the curtain from the track in a slidable manner. The curtain tracks are generally supported by brackets from an upright wall adjacent to the window opening or from an adjacent ceiling.

The connection between bracket and track may fall into two general categories. The first known type of connection between track and bracket is a push-type fit where the track is pushed upwardly against a portion of the bracket which extends outwardly from the wall. The difficulty with such an arrangement is that pushing a track upward into a series of spaced brackets at a considerable height from the floor is generally inconvenient and awkward for the installer. Furthermore, in such arrangements, once the engagement has been effected, the track and bracket are not able to be freely separated. This may cause some difficulty if it is necessary to take down the track for cleaning or repair, especially if the track obstructs access to the fasteners securing the bracket to the upright wall or the ceiling.

The other known type of connection between bracket and track is generally in the form of a manually operable latch. It will be appreciated that this requires the installer to operate a lever or turn a knob to effect engagement with the track, leaving only one hand free to hold and position the track. In view of the fact that modern tracks can be quite lengthy such latch-type connections are cumbersome and awkward for installers to use.

Our New Zealand patent specification number 335989 describes a modified track assembly and mounting device. That system uses a mounting device that enables ready attachment and detachment of the track. The device has a resilient release means. A user can readily remove the track from the mounting device using a tool such as a screwdriver. To do so, the user applies force against the release means with the tool, while turning the tool to prise the track off the mounting device. The mounting device is a reasonably thick component and does not readily lend itself to being manufactured from metal. The mounting device has a relatively short resilient release means that must be flexed to release the mounting device from the track. If the device was manufactured from metal, the tongue portion would not have sufficient resilient flexibility to enable the track to be removed from the mounting device by using a tool in the manner described above.

The object of the present invention therefore is to provide a track assembly or a mounting device for a track assembly which overcomes or at least ameliorates some of the above mentioned disadvantages. An alternative object is to provide the public with a useful choice.

In this specification where reference has been made to patent specifications, other external documents, or other sources of information, this is generally for the purpose of providing a context for discussing the features of the invention. Unless specifically stated otherwise, reference to such external documents or such sources of information is not to be construed as an admission that such documents or such sources of information, in any jurisdiction, are prior art or form part of the common general knowledge in the art.

SUMMARY OF THE INVENTION

The term "comprising" as used in this specification means "consisting at least in part of". When interpreting each statement in this specification that includes the term "comprising", features other than that or those prefaced by the term may also be present. Related terms such as "comprise" and "comprises" are to be interpreted in the same manner.

In accordance with a first aspect of the present invention, there is provided a mounting device for installing a track for a curtain or blind, the mounting device comprising:

an engagement portion for cooperation with a corresponding engagement portion on the track by means of a snap-type engagement;

and a resiliently deformable release means for releasing the engagement portion from the corresponding engagement portion on the track, the release means comprising a tongue portion having at least part of the engagement portion formed thereon, and that has a free end that is arranged to be positioned in a cavity of the track when the engagement portions are fully mutually engaged and a connected end that is connected to the mounting portion and spaced from the free end and that is arranged to be positioned externally of the cavity of the track when the engagement portions are fully mutually engaged, the tongue portion further comprising an abutment face disposed for assisting with prising apart the mounting device and the track with a tool by turning the tool, simultaneous with the operation of the tool against the tongue portion to disengage the engagement portion from the snap-type engagement with the track, wherein the mounting device is such that the abutment face is opposed to and spaced from the track in use when the engagement portions are fully mutually engaged.

A "snap-type" engagement means is one in which the two mutually co-operable engagement portions may be engaged together by a single action which precludes the operation of a manually operable lever or catch to effect the engagement. In a most preferred form of the invention, the engagement portions are such that they may be released from engagement through the use of a common tool such as a screwdriver.

Preferably, the mounting device further comprises a support member adjacent the tongue portion, wherein the support member has a distal end generally adjacent the free end of the tongue portion and that is arranged to be positioned in the cavity of the track. Preferably, the mounting device comprises two support members adjacent the tongue portion, wherein each support member has a distal end generally adjacent the free end of the tongue portion and that is arranged to be positioned in the cavity of the track, and the support members are positioned on opposite sides of the tongue portion. Preferably, the mounting device further comprises a cross member that connects the distal ends of the support members, and the support members and cross members define a recess within which the tongue portion is positioned.

Preferably, the support member(s) is/are substantially rigid.

Preferably, the support member(s) is/are longer than the tongue portion, and the distal end(s) of the support member(s) is/are arranged to abut an end wall in a cavity of the track when the engagement portions are fully mutually engaged, with the free end of the tongue portion being arranged to be spaced from the end wall in the cavity so the end wall of the cavity does not interfere with movement of the tongue portion.

Preferably, the support member(s) is/are horizontally spaced from the tongue portion.

Preferably, part(s) of the support member(s) is/are substantially coplanar with part of the tongue portion. Preferably, the support member(s) comprise(s) a lower face that is/are substantially co-planar with a lower face of the tongue portion, and the support member(s) further comprise(s) an upper face that is/are vertically spaced from the lower face(s) of the support member(s) and from the tongue portion, with the upper face(s) arranged to contact an upper surface in the cavity of the track and the lower face(s) arranged to contact a lower surface in the cavity of the track, to provide a stable connection between the mounting device and the track when the engagement portions are fully mutually engaged. Preferably, the upper face(s) of the support member(s) comprise(s) upwardly directed protrusion(s) that is/are arranged to contact the upper surface in the cavity of the track. Preferably, the tongue portion comprises a downwardly directed engagement projection that is arranged to engage with a detent of the cavity of the track to engage the track to the mounting device, and the upwardly directed protrusion(s) is/are substantially aligned with the engagement projection.

Preferably, the tongue portion comprises a downwardly directed engagement projection that is arranged to engage with a detent of the cavity of the track to engage the track to the mounting device, and the abutment face on the tongue portion comprises part of a downwardly directed abutment projection. The engagement projection and abutment projection may be angled toward one another, or alternatively one or both of the projections could be substantially vertical for example.

Suitably, the abutment face on the tongue portion is arranged to be spaced from an abutment face of the track by a distance less than the dimension between the longitudinal edges of an averagely sized screwdriver blade. The mounting device is preferably configured for release by a screwdriver having a blade with a longitudinal axis defining a longitudinal direction, wherein the track and the mounting device are prised apart by initially moving the screwdriver in the longitudinal direction and then turning the screwdriver about the longitudinal axis.

Preferably, the mounting device is configured such that the track can be mounted to the mounting device by substantially linear movement of the track in a direction from the free end of the tongue portion toward the fixed end of the tongue portion.

Preferably, the mounting device comprises pressed metal. Preferably, the metal comprises spring steel. Preferably, the mounting device comprises pressed tempered metal.

In accordance with a second aspect of the present invention, there is provided a track system for a curtain or blind comprising:

a substantially rigid track; and at least one mounting device as outlined in relation to the first aspect above for releasably mounting the track onto a wall-mounted or ceiling-mounted bracket;

wherein the track comprises an engagement portion that is mutually co-operable with the engagement portion of the mounting device by means of a snap-type engagement effective to hold the track in an operational position on the bracket to support a curtain or blind.

Preferably, the engagement portions are adapted to be released from engagement through the use of a screwdriver.

The track system may further comprise the bracket, with the mounting device being a discrete member attachable to the bracket. Alternatively, the bracket may be of integral construction with the mounting device. Preferably, the bracket comprises a mounting portion for mounting to an upright wall surface or an adjacent ceiling, and the system is such that the track can be assembled with the mounting device by pushing the track towards the upright wall surface in a substantially linear direction substantially orthogonal to the upright wall surface to effect the snap-type engagement between the mutually co-operable engagement portions of the mounting device and the track.

Preferably, the track comprises an abutment face that is adapted to be opposed to and spaced apart from the abutment face provided on the mounting device in the assembled configuration of the mounting device portion and the track, the spacing therebetween being adapted to receive a tool to assist with prising apart the abutment faces and thereby assist with separating the track and the mounting device. Preferably, the track system is configured for release by a screwdriver having a blade with a longitudinal axis defining a longitudinal direction, wherein the track and mounting device portion are prised apart by initially moving the screwdriver in the longitudinal direction and then turning the screwdriver about the longitudinal axis.

The track system may be provided in unassembled form, for sale as a kit of parts. In a preferred form of the invention a large number of mounting devices may be required to assemble a single track and therefore the track and mounting devices may be sold as separate items intended for use together. In the assembled track system, a plurality of mounting devices may be disposed at spaced locations along the length of the track. The mounting devices may be attached to respective brackets mounted to an adjacent wall or ceiling.

Preferably the engagement between the mounting device and the track is a push-fit i.e. where one portion is insertable into another. Preferably the mounting device includes one or more resiliently deformable portions, the track being rigid to receive the or each resiliently deformable portion. For example a resilient projection may be provided which is insertable into a metal cavity or channel. In a most preferred form of the invention, the resilient projection is provided on the mounting device with the resilient projection being insertable into a channel provided in the track.

The release means is provided to selectively i.e. at the option of the installer, release the engagement between the mounting device and the track. The track may include a plurality of engagement portions at spaced locations along the track. However it is preferable that the track is a continuous section with the engagement portion provided as a dedicated portion of the track, such that the track can be connected to the mounting devices at any position along the length of the track. As such, the engagement portion may be in the form of a fixing channel co-operable with the engagement portion provided on the mounting device portion. The fixing channel may be separate from the channel in which the gliders' operate. In a most preferred form of the invention, the engagement channel and the glider channel are incorporated into an integral extruded track of continuous cross-section.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

Where specific integers are mentioned herein which have known equivalents in the art to which this invention relates, such known equivalents are deemed to be incorporated herein as if individually set forth.

The invention consists in the foregoing and also envisages constructions of which the following gives examples only.

BRIEF DESCRIPTION OF THE DRAWINGS

In order that the invention may be more fully understood, one preferred form of the present invention will now be described with reference to the accompanying figures in which:

FIG. 1 shows an end view of a curtain track for use in a track system in accordance with a preferred embodiment of the present invention;

FIG. 2 shows a perspective view of a bracket for use in a track system in accordance with a preferred embodiment of the present invention;

DETAILED DESCRIPTION OF PREFERRED FORMS

Figure 3:
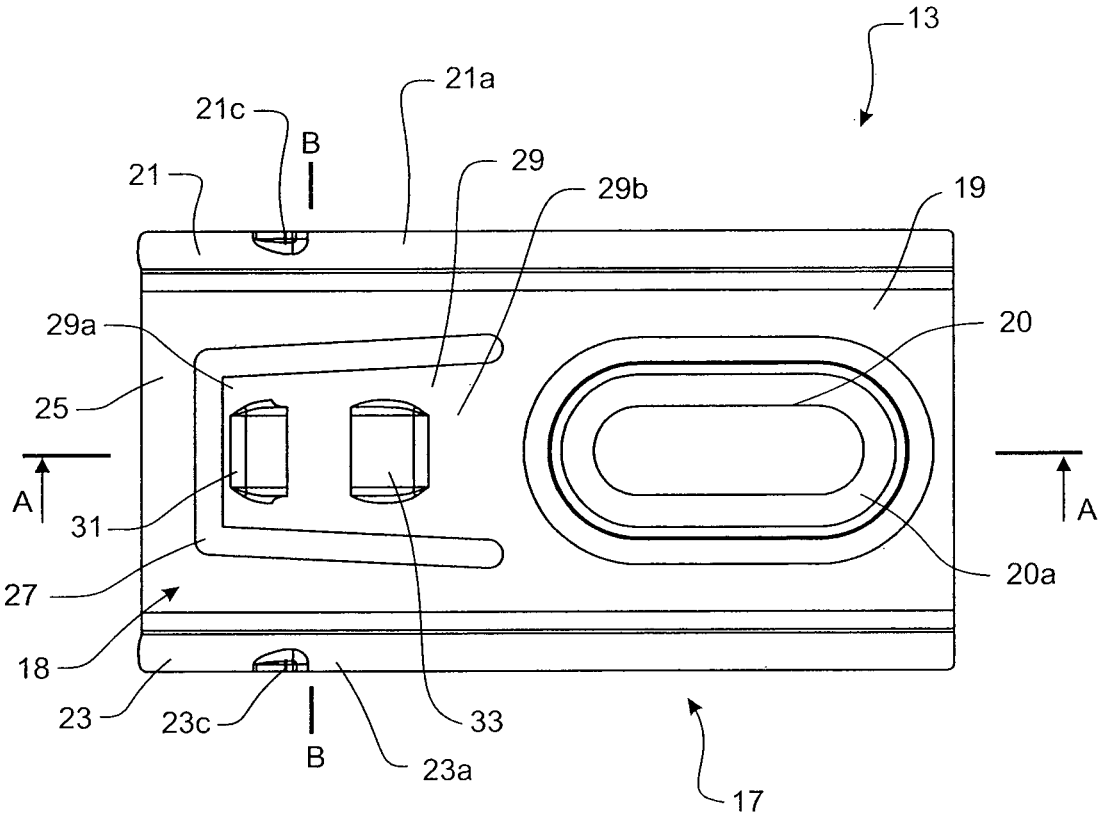
FIG. 3 shows a top view of a mounting device for use with the bracket of FIG. 2 to support the curtain track of FIG. 1.
Figure 4:
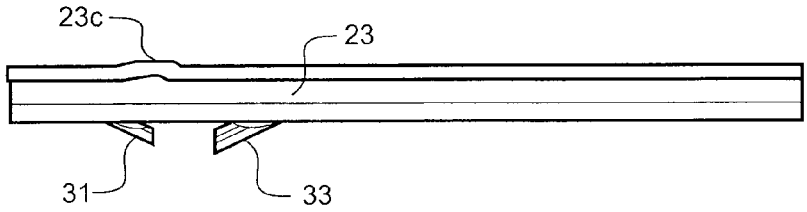
FIG. 4 shows a side view of the mounting device of FIG. 3.

As shown in FIG. 1, the curtain track 1 comprises a cavity, which in the form shown is a fixing channel 2, and a glider channel 3. The glider channel 3 is in a substantially C-shaped configuration, and receives curtain gliders (not shown), examples of which are well known in the art. The gliders move within the glider channel 3 in the longitudinal direction of the curtain track 1 as the curtains are drawn. The curtain track 1 is typically an extruded aluminium alloy for light weight, and is powder coated for aesthetic purposes and durability.

The curtain track 1 includes an abutment face 4 on the outer surface thereof between the open edges of the fixing channel 2 and the glider channel 3. The upper part of the abutment face 4 forms a detent 5 at the open edge of the fixing channel 2. The base 6 of the fixing channel 2 is angled at the outer end thereof to form a substantially V-shaped groove 7 adjacent to the detent 5.

The curtain track 1 may be detachably mounted to the mounting device of FIG. 3 which is mounted to the bracket of FIG. 2 which is fixed to a wall or to an adjacent ceiling.

FIG. 2 shows L-shaped bracket 8 which comprises a wall-mounting portion 9 and a projecting arm 10. The wall mounting portion 9 includes apertures 11 for fixing the bracket 8 to a wall (not shown) with fasteners such as screws (not shown). The bracket 8 is typically made of metal.

The projecting arm 10 extends from the upper part of the wall mounting portion 9 in a rigid cantilever fashion. The projecting arm 10 comprises a slot 12 to receive a fastener such as a screw (not shown) to fasten a mounting device 13 (see FIG. 3) to the bracket 8. The projecting arm 10 further comprises downward- and inward-facing flanges 14 and 15, one on either side. The flanges 14 and 15 extend below the lower surface 16 of the projecting arm.

Rather than being mounted to a wall, the bracket could instead be mounted to a ceiling adjacent the wall. Fasteners can be inserted upwardly through the aperture 12*a* and the end 12*b* of the aperture 12 to mount the bracket to the ceiling.

FIG. 3 shows a top view of the mounting device 13 which comprises a clip having a body portion 17. The body portion comprises a mounting portion 19, first and second substantially parallel and horizontally spaced support members 21, 23, and a cross member 25 that connects ends of the support members 21, 23 at an end of the body portion distal the mounting portion 19. At least the support members 21, 23 of the body portion are substantially rigid. The support members may extend the full length of the body portion, or may only extend adjacent the resilient tongue portion 29 described below.

The body portion 17 comprises a recess 27 formed by the mounting portion 19, the first and second support members 21, 23, and the cross member 25. A resiliently deformable tongue portion 29 is positioned within the recess 27, and has a free end 29*a* distal the mounting portion 19 that is arranged to be positioned in the cavity 2 of the track when the track is mounted to the mounting device, and a connected end 29*b* spaced from the free end 29*a* and proximate the mounting portion and that is arranged to be positioned externally of the cavity 2 of the track when the track is mounted to the mounting device. The tongue portion 29 is connected to the mounting portion 19 at the connected end 29*b* of the tongue portion, and the free end 29*a* of the tongue portion is positioned adjacent the cross member 25 of the body portion.

The support members 21, 23 of the body portion 17 comprise upper surfaces 21*a*, 23*a* that may be located against the lower surface 16 of the projecting arm 10 of the bracket 8 when the mounting device 13 is removably attached to the projecting arm 10 of the bracket. The body portion 17 further comprises a slot 20 to receive a fastener (not shown) which attaches the mounting device 13 to the projecting arm 10 of the bracket. An upper surrounding edge 20*a* of the slot 20 is coplanar with upper surfaces 21*a*, 23*a* of the support members 21, 23. The outer edges of the support members 21, 23 of the body portion 17 are located by the downward- and inward-facing flanges 14 and 15 respectively when the mounting device 13 is attached to the bracket 8.

Figure 5:
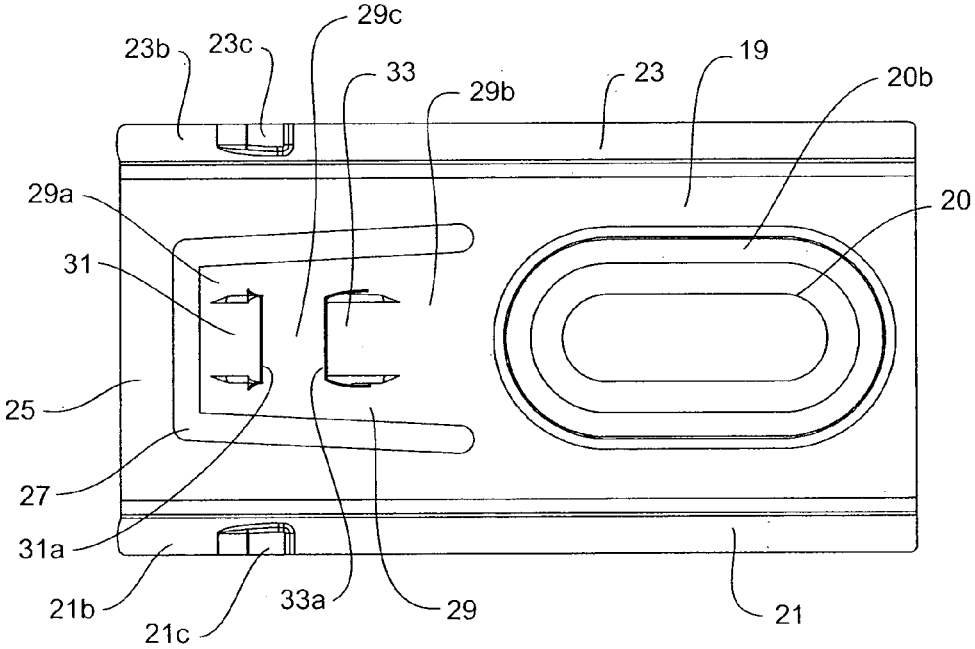
FIG. 5 shows a bottom view of the mounting device of FIG. 3.
Figure 6:
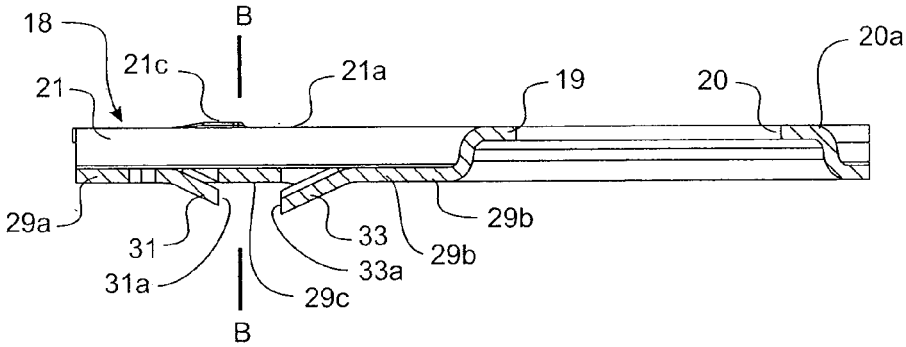
FIG. 6 shows a longitudinal section through line A-A of FIG. 3.
Figure 7:
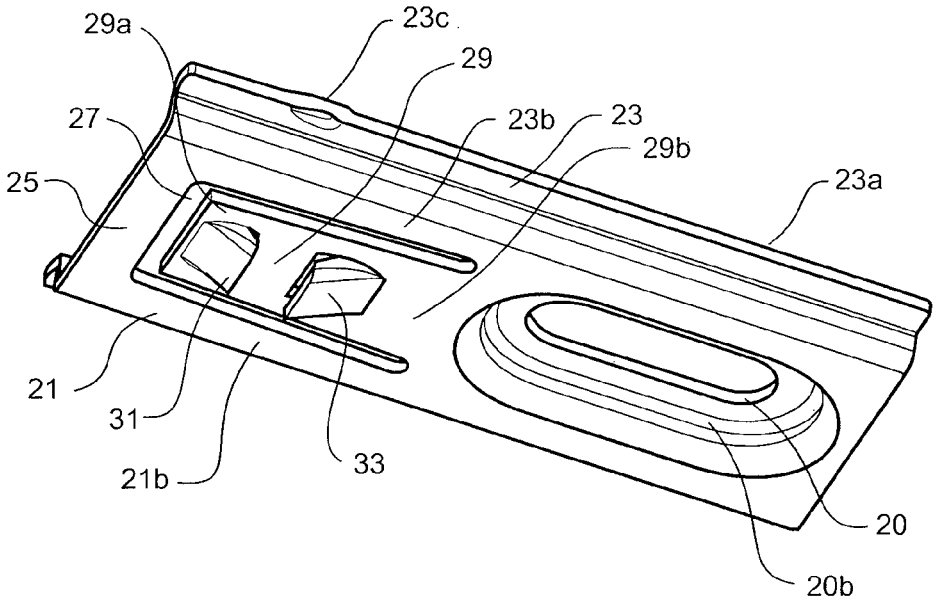
FIG. 7 shows a perspective view of the underside of the mounting device of FIG. 3.
Figure 8:
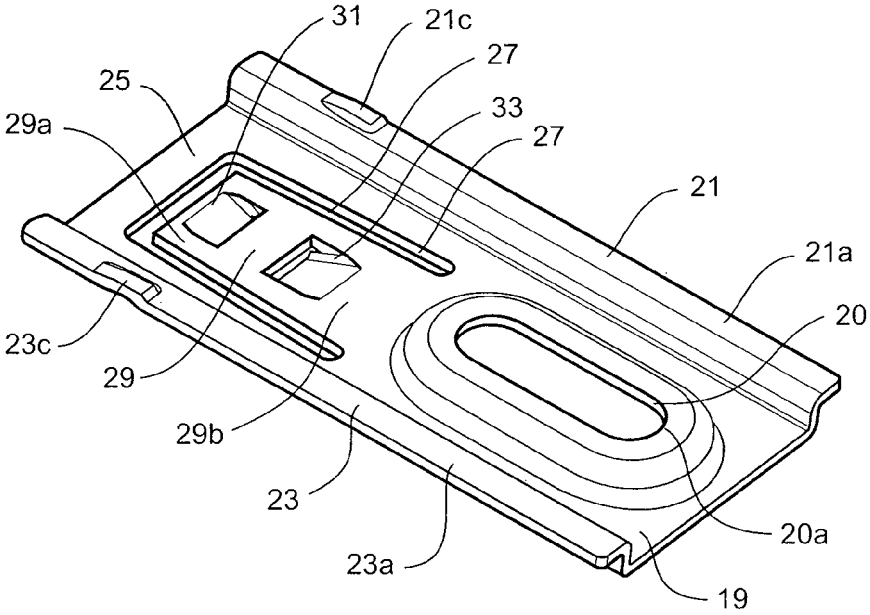
FIG. 8 shows a perspective view of the upper side of the mounting device of FIG. 3.

Referring to FIG. 5, a recess 20*b* is provided in the lower part of the mounting portion 17 to receive the head of the fastener (not shown), which connects the mounting device to the bracket.

Referring to FIG. 3, when the mounting device is attached to the bracket, the portions of the support members 21, 23 to the left side of line 'B-B' in the figure, the cross member 25, and the portion of the tongue portion 29 to the left side of line 'B-B' in the figure together form a projecting tab 18 that is receivable in the fixing channel 2 of the curtain track 1 in a frictional manner. The projecting tab 18 and the channel 2 act as engagement portions. The recess 27 extends between the three free sides of the tongue portion 29 and the remainder of the projecting tab 18.

The vertical thickness of the tongue portion 29 is generally less than the thickness of the portions of the support members 21, 23 in the projecting tab 18, to enable the tongue portion to be bent upward at its connected end in a resilient manner. When the tongue portion is not being resiliently bent, lower faces 21*b*, 23*b* of the support member are co-planar with a lower face 29*c* of the tongue portion. The upper faces 21*a*, 23*a* of the support members are vertically spaced from the lower faces of the support members 21*b*, 23*b* and from the tongue portion. The upper faces 21*a*, 23*a* of the support members 21, 23 are arranged to contact the upper surface 2*a* in the cavity 2 of the track and the lower faces 21*b*, 23*b* are arranged to contact a lower surface 2*b* in the cavity 2 of the track, to provide a stable connection between the mounting device and the track when the track and mounting device are engaged.

In the projecting tab 18, the support members 21, 23 are longer than the tongue portion 29. The free ends of the support members are arranged to abut an end wall 2*c* in the cavity 2 of the track when the track and mounting device are engaged. The free end 29*b* of the tongue portion is arranged to be spaced from the end wall in the cavity of the track so the end wall 2*c* of the cavity does not interfere with the resilient movement of the tongue portion.

The engagement portion of the mounting device comprises a downwardly directed engagement projection 31 that is positioned on the tongue portion 29 and that is angled away from the free end 29*b* of the tongue portion. The engagement projection 31 has an exposed face 31*a* that is arranged to engage with the detent 5 of the track to engage the track to the mounting device. The upper faces 21*a*, 23*a* of the support members comprise upwardly directed protrusion 21*c*, 23*c* that are arranged to contact the upper surface 2*a* in the cavity of the track. The upwardly directed protrusions 21*c*, 23*c* of the upper surfaces of the support members are positioned above the engagement projection 31. The protrusions 21*c*, 23*c* may be formed by bent portions of the metal.

The mounting device may have further upwardly directed projections (not shown) to locate the mounting device in a desired position relative to the bracket 8. For example, the mounting device may have upwardly directed projections positioned along either edge of the mounting device (and generally aligned with protrusions 21*c*, 23*c*) and substantially above the downwardly directed projection 33. The upwardly directed projections will engage against the edge 16 of the bracket, and may be formed by portions of the metal that have been cut and pressed upwardly, with their free ends engaging against the edge 16.

The resilient tongue portion further comprises an abutment face disposed for assisting with prising apart the mounting device 13 and the track 1 with a tool by turning the tool, simultaneous with the operation of the tool against the tongue portion 29. In the form shown, the abutment face 33*a* is formed by an exposed face of a downwardly directed projection 33 that is spaced from and angled toward the engagement projection 31.

Figure 9:
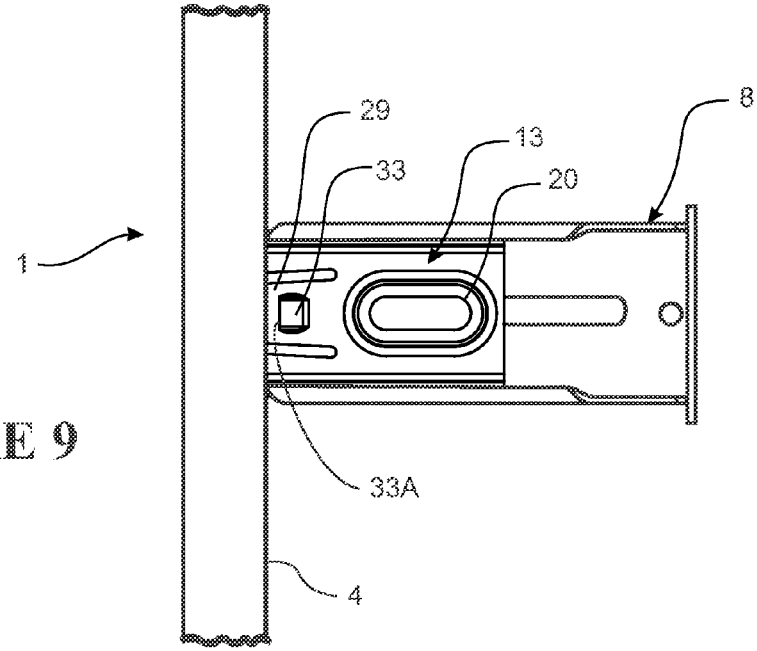
FIG. 9 shows a bottom view of the curtain track of FIG. 1, mounting device of FIG. 3 and bracket of FIG. 2 in assembled configuration.
Figure 10:
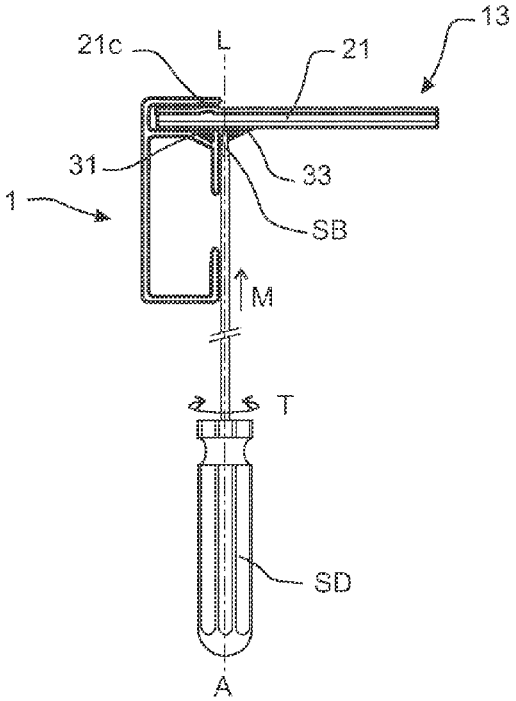
FIG. 10 shows a side view of the assembly of FIG. 9, but with the bracket not shown for clarity.

FIG. 10 shows a side view of the curtain assembly with the bracket 8 attached to the mounting device 13 (fastener not shown) and the mounting device attached to the curtain track 1, and FIG.9 shows a bottom view thereof. When the projecting tab 18 of the mounting device is fully positioned in the fixing channel 2 of the curtain track, the exposed face 31*a* of the engagement projection 31 is positioned in the V-shaped groove 7 of the track behind the detent, and is positioned against an inner surface 5*a* of the track detent. A major part of the tongue portion 29, including the connected end 29*b*, the abutment projection 33, and more than half of the portion of the tongue portion between the two projections 31, 33, is positioned externally of the track. The engagement between the engagement projection 31 and the detent 5 is such that the projecting tab 18 cannot under normal operating conditions be removed from the fixing channel 2 unless the tongue portion 29 is pushed up vertically such that the engagement projection 31 clears the upper edge of the detent 5.

The distance (typically between about 11 mm and 13 mm) between the inner edges of the support members 21, 23 at the recess 27 is ample to receive the dimension between the longitudinal edges of the blade of a typical screwdriver. However, the distance (typically about 2-4 mm) between the abutment face 4 of the curtain track 1 and the abutment face 33*a* of the tongue portion 29 of the mounting device is less than the dimension between the longitudinal edges of the blade of a typical screwdriver.

Figure 11:
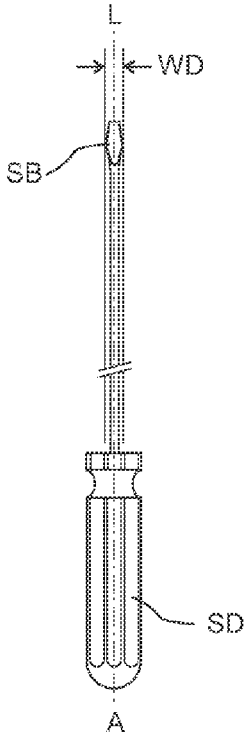
FIG. 11 shows a side view of a typical screwdriver that can be used to remove the curtain track from the bracket.

FIGS. 10 and 11 show a screwdriver S having a screwdriver blade SB with a longitudinal axis LA. The screwdriver blade has a wide dimension WD between the longitudinal edges of the screwdriver blade, and a narrow dimension that is transverse to the wide dimension.

In order to detach the track 1 from the mounting device 13, a screwdriver blade (not shown) with its blade extending substantially parallel to the abutment face of the track may be pushed vertically upwards U along the longitudinal axis LA against the tongue portion 29, causing the tongue portion 29 to bend up at its connected end and causing the engagement projection 31 to vertically clear the detent 5. While still applying the vertical force with the screwdriver, the screwdriver is turned T about the longitudinal axis LA; causing the longitudinal edges of the blade to contact the abutment face 4 of the curtain track 1 and the abutment face 33*a* of the tongue portion 29 of the mounting device 13. As the screwdriver is turned further, the increased force against the abutment face 4 and the abutment face 33*a* causes these faces to separate, also separating the projecting portion 18 of the mounting device 13 from the fixing channel 2 of the curtain track 1. Instead of using a screwdriver, a different type of tool could be used, provided it has suitable proportions for acting on the abutment faces.

The mounting device is manufactured from metal sheet that has been pressed into the shape shown. The metal may be any suitable type such as steel or aluminium alloy, but is preferably spring steel. Most preferably, the metal is 21 gauge (approximately 0.80 mm thickness) cold rolled, 85% minimum spheroidised annealed steel. Following pressing into shape, the mounting device will be heat treated or tempered to achieve a harness of about 42-44 HRC. Preferably, the mounting device will be powder coated with a thickness of about 0.10 mm, in any suitable colour for the intended application and to provide durability.

The dimensions of the device will be selected to suit the application and required performance. However, the configuration shown enables the tongue portion to be sufficiently long to provide the required resilience. By way of example, in the embodiment described manufactured from spring steel, the tongue portion 29 preferably has a length of at least about 10 mm, and more preferably of about 15 mm, from its connected end to its free end.

Assembly and Disassembly

A mounting device 13 is placed against the projecting arm 10 of a bracket 8 by placing the upper surfaces 21*a*, 23*a*, 20*a* of the body portion 17 of the mounting device against the lower surface 16 of the bracket 8. The outer edges 21 and 22 of the body portion 17 of the mounting device are located by the downward- and inward-facing flanges 14 and 15 respectively of the bracket 8. A fastener (not shown) extends through the slot 12 of the bracket 8 which is aligned with the slot 20 of the mounting device 13 to secure the bracket and the mounting device together. The bracket 8 is attached to a wall (not shown) in the required location above a window by using fasteners (not shown) in the apertures 11 of the wall mounting portion 9, or is attached to a ceiling adjacent the wall. This procedure is followed for as many brackets and mounting devices as are required depending on the length of curtain track 1. If necessary, the curtain track 1 is cut to the required length before attachment to the mounting devices. However, the releasable nature of the join between the mounting devices and the curtain track means that the curtain track can be easily removed for adjustment if required.

The curtain track 1 is attached to each mounting device 13 in the following manner. The fixing channel 2 of the curtain track 1 is aligned with the free end of the projecting tab 18 of the mounting device 13. The curtain track 1 is then pushed against the mounting device 13 in a substantially linear direction substantially orthogonal to the wall surface so that the projecting tab 18 is pushed into the fixing channel 2, and such that the engagement projection 31 of the tongue portion 29 of the mounting device 13 is seated in the substantially V-shaped groove 7 of the fixing channel 2 of the curtain track. The detent 5 of the curtain track 1 is positioned against the exposed face 31*a* of the engagement projection 31, and is positioned between the engagement projection 31 and the abutment face 33*a*.

Once the curtain track 1 is fitted to the required number of mounting devices, the curtains may be hung from the curtain track by inserting a plurality of gliders (not shown) into the glider channel 3 of the curtain track 1. Alternatively, the gliders may be inserted into the glider channel 3 before fixing the curtain track 1 to the mounting devices 13. The ends of the track 1 are closed by appropriate end caps (not shown) as well known in the art.

If the curtain track is required to be removed from a mounting device, the blade of a typical screwdriver (not shown) is pushed up against the portion of the tongue portion 29 between the abutment face 4 of the curtain track and the abutment face 33*a* of the mounting device. The upwards force on the tongue portion 29 is sufficient to cause the engagement projection 31 of the tongue portion 29 to bend upwardly and clear the detent 5 of the curtain track 1. The screwdriver is then turned while still applying the upwards force such that the longitudinal edges of the blade contact the abutment face 4 of the curtain track 1 and the abutment face 33*a* of the tongue portion of the mounting device 1. As the screwdriver is turned further, the increased force against the opposed abutment face 4 and the abutment face 33*a* separates the faces, causing the engagement projection 31 of the tongue portion 29 of the mounting device 13 to move outwards of the detent 5 of the curtain track 1, releasing the projecting tab of the mounting device from the fixing channel 2 of the curtain track. This removal procedure is followed for each of the mounting devices. In this manner, the track is removed from the mounting device via movement of the track away from the wall in a substantially linear direction substantially orthogonal to the wall.

Any adjustments that are required may then be made to the curtain track 1 or curtains (not shown), and the curtain track may then be reattached to the mounting devices 13 as outlined above.

The above describes preferred forms of the present invention, and modifications may be made thereto without departing from the scope of the present invention.

For example, while the mounting device and the bracket are described as separate components that are connected to one another, they could alternatively be integrally formed with each other. Other example modifications are listed in the summary of the invention section.

As another example, in the embodiment shown in the figures, the bracket mounting portion 19 of the mounting device is generally aligned with the projecting tab 18. Instead, the mounting portion 19 and the projecting tab 18 could be vertically offset from one, another, with a vertical wall interconnecting the mounting portion 19 and the projecting tab 18 to form a somewhat Z shape in side view. The projecting tab 18 would be positioned lower than the mounting portion 19. This will enable two mounting devices to be fixed to a single bracket, with a device as shown in FIGS. 4 to 10 positioned generally above the modified device described in this paragraph, so two curtain tracks can be supported from the brackets at different heights.

The preferred form mounting device has a resilient tongue portion with a connected end at the mounting portion and a free end that is received in the track cavity, and an abutment face on the tongue portion. With this configuration, the tongue portion can easily be made a sufficient length to provide the necessary resilient flexibility, so the device can be manufactured from a suitable metal. In the preferred form, the mounting device can be pressed from a suitable material such as spring steel and then tempered, which provides a low cost and strong product.

The invention claimed is:

1. A mounting device for installing a track for a curtain or blind, the mounting device comprising:

a mounting portion;

a first engagement portion for cooperation with a corresponding second engagement portion on the track by means of a snap-type engagement;

and a resiliently deformable release means for releasing the first engagement portion from the corresponding second engagement portion on the track, the release means comprising a tongue portion that is arranged to be oriented substantially horizontally in use and having at least part of the first engagement portion formed thereon, and that has a free end that is arranged to be positioned in a cavity of the track when the first and second engagement portions are fully mutually engaged and a connected end that is connected to the mounting portion and spaced from the free end and that is arranged to be positioned externally of the cavity of the track when the first and second engagement portions are fully mutually engaged, the tongue portion further comprising an abutment face disposed for assisting with prising apart the mounting device and the track with a tool by turning the tool, simultaneous with the operation of the tool against the tongue portion to disengage the first engagement portion from the snap-type engagement with the track, wherein the tongue portion comprises a downwardly directed engagement projection that is arranged to engage with a detent of the cavity of the track to engage the track to the mounting device, and the abutment face on the tongue portion comprises a downwardly directed abutment proiection, wherein the mounting device is such that the abutment face is opposed to and spaced from the track in use when the first and second engagement portions are fully mutually engaged, and wherein the track is disengageable from the mounting device by inserting the tool between the abutment face and track, pushing the tool vertically upwards against the tongue portion so that the engagement projection vertically clears the detent, and turning the tool.

2. The mounting device as claimed in claim 1, comprising a support member adjacent the tongue portion, wherein the support member has a distal end generally adjacent the free end of the tongue portion and that is arranged to be positioned in the cavity of the track.

3. The mounting device as claimed in claim 2, comprising two support members adjacent the tongue portion, wherein each support member has a distal end generally adjacent the free end of the tongue portion and that is arranged to be positioned in the cavity of the track, and the support members are positioned on opposite sides of the tongue portion.

4. A mounting device for installing a track for a curtain or blind, the mounting device comprising:

a mounting portion;

a first engagement portion for cooperation with a corresponding second engagement portion on the track by means of a snap-type engagement;

and a resiliently deformable release means for releasing the first engagement portion from the corresponding second engagement portion on the track, the release means comprising a tongue portion having at least part of the first engagement portion formed thereon, and that has a free end that is arranged to be positioned in a cavity of the track when the first and second engagement portions are fully mutually engaged and a connected end that is connected to the mounting portion and spaced from the free end and that is arranged to be positioned externally of the cavity of the track when the first and second engagement portions are fully mutually engaged, the tongue portion further comprising an abutment face disposed for assisting with prising apart the mounting device and the track with a tool by turning the tool, simultaneous with the operation of the tool against the tongue portion to disengage the engagement portion from the snap-type engagement with the track, wherein the mounting device is such that the abutment face is opposed to and spaced from the track in use when the first and second engagement portions are fully mutually engaged, and wherein the mounting device comprises two support members adjacent the tongue portion, wherein each support member has a distal end generally adjacent the free end of the tongue portion and that is arranged to be positioned in the cavity of the track, and the support members are positioned on opposite sides of the tongue portion, and wherein the mounting device further comprises a cross member that connects the distal ends of the support members, wherein the support members and cross member define a recess within which the tongue portion is positioned.

5. The mounting device as claimed in claim 2, wherein the support member is substantially rigid.

6. The mounting device as claimed in claim 2, wherein the support member is longer than the tongue portion, and the distal end of the support member is arranged to abut an end wall in a cavity of the track when the first and second engagement portions are fully mutually engaged, with the free end of the tongue portion being arranged to be spaced from the end wall in the cavity so the end wall of the cavity does not interfere with movement of the tongue portion.

7. The mounting device as claimed in claim 2, wherein the support member is horizontally spaced from the tongue portion.

8. The mounting device as claimed in claim 2, wherein part of the support member is substantially coplanar with part of the tongue portion.

9. The mounting device as claimed in claim 8, wherein the support member comprise a lower face that is substantially co-planar with a lower face of the tongue portion, and the support member further comprise an upper face that is vertically spaced from the lower face of the support member and from the tongue portion, with the upper face arranged to contact an upper surface in the cavity of the track and the lower face arranged to contact a lower surface in the cavity of the track, to provide a stable connection between the mounting device and the track when the first and second engagement portions are fully mutually engaged.

10. A mounting device for installing a track for a curtain or blind, the mounting device comprising:

a mounting portion;

a first engagement portion for cooperation with a corresponding second engagement portion on the track by means of a snap-type engagement;

and a resiliently deformable release means for releasing the first engagement portion from the corresponding second engagement portion on the track, the release means comprising a tongue portion having at least part of the first engagement portion formed thereon, and that has a free end that is arranged to be positioned in a cavity of the track when the first and second engagement portions are fully mutually engaged and a connected end that is connected to the mounting portion and spaced from the free end and that is arranged to be positioned externally of the cavity of the track when the first and second engagement portions are fully mutually engaged, the tongue portion further comprising an abutment face disposed for assisting with prising apart the mounting device and the track with a tool by turning the tool, simultaneous with the operation of the tool against the tongue portion to disengage the first engagement portion from the snap-type engagement with the track, wherein the mounting device is such that the abutment face is opposed to and spaced from the track in use when the first and second engagement portions are fully mutually engaged, the mounting device further comprising a support member adjacent the tongue portion, wherein the support member has a distal end generally adjacent the free end of the tongue portion and that is arranged to be positioned in the cavity of the track, wherein part of the support member is substantially coplanar with part of the tongue portion, wherein the support member comprises a lower face that is substantially co-planar with a lower face of the tongue portion, and the support member further comprises an upper face that is vertically spaced from the lower face of the support member and from the tongue portion, with the upper face arranged to contact an upper surface in the cavity of the track and the lower face arranged to contact a lower surface in the cavity of the track, to provide a stable connection between the mounting device and the track when the first and second engagement portions are fully mutually engaged, and wherein the upper face of the support member comprises an upwardly directed protrusion that is arranged to contact the upper surface in the cavity of the track.

11. The mounting device as claimed in claim 10, wherein the upwardly directed protrusion is substantially aligned with the engagement projection.

12. The mounting device as claimed in claim 1, wherein the engagement projection and abutment projection are angled toward one another.

13. The mounting device as claimed in claim 1, wherein the abutment face on the tongue portion is arranged to be spaced from an abutment face of the track by a distance of between about 2-4 mm.

14. The mounting device as claimed in claim 13, configured for release by a screwdriver having a blade with a longitudinal axis defining a longitudinal direction, wherein the track and the mounting device are prised apart by initially moving the screwdriver vertically upwards in the longitudinal direction and then turning the screwdriver about the longitudinal axis.

15. The mounting device as claimed in claim 1, wherein the mounting device is configured such that the track can be mounted to the mounting device by substantially linear movement of the track in a direction from the free end of the tongue portion toward the connected end of the tongue portion.

16. The mounting device as claimed in claim 1, wherein the mounting device comprises pressed metal.

17. The mounting device as claimed in claim 16, wherein the metal comprises spring steel.

18. The mounting device as claimed in claim 16, wherein the mounting device comprises pressed tempered metal.

19. A track system for a curtain or blind comprising:

a substantially rigid track; and at least one mounting device as claimed in claim 1 for releasably mounting the track onto a wall-mounted or ceiling-mounted bracket;

wherein the track comprises the second engagement portion that is mutually co-operable with the first engagement portion of the mounting device by means of a snap-type engagement effective to hold the track in an operational position on the bracket to support a curtain or blind.

20. The track system as claimed in claim 19, wherein the track and mounting device are engageable at any position along the length of the track.

21. The track system as claimed in claim 19, wherein the first and second engagement portions are adapted to be released from engagement through the use of a screwdriver, by prising apart the mounting device and the track by turning the screwdriver, simultaneous with operation of the screwdriver against the tongue portion to disengage the first engagement portion from the snap-type engagement with the track.

22. The track system as claimed in claim 19, further comprising the wall-mounted or ceiling-mounted bracket, with the mounting device being a discrete member attachable to the wall-mounted or ceiling-mounted bracket.

23. The track system as claimed in claim 19, further comprising the wall-mounted or ceiling-mounted bracket which is of integral construction with the mounting device.

24. The track system as claimed in claim 22, wherein the wall-mounted or ceiling-mounted bracket comprises a mounting portion for mounting to an upright wall surface or an adjacent ceiling, and the system is such that the track can be assembled with the mounting device by pushing the track towards the upright wall surface in a substantially linear direction substantially orthogonal to the upright wall surface to effect the snap-type engagement between the mutually co-operable first and second engagement portions of the mounting device and the track.

25. The track system as claimed in claim 19, wherein the track comprises an abutment face that is adapted to be opposed to and spaced apart from the abutment face provided on the mounting device in the assembled configuration of the mounting device and the track, the spacing therebetween being adapted to receive a tool to assist with prising apart the abutment faces and thereby assist with separating the track and the mounting device.

26. The track system as claimed in claim 25, configured for release by a screwdriver having a blade with a longitudinal axis defining a longitudinal direction, wherein the track and mounting device portion are prised apart by initially moving the screwdriver upwards in the longitudinal direction and then turning the screwdriver about the longitudinal axis.

* * * * *